United States Patent [19]

Burns et al.

[11] Patent Number: 4,702,692

[45] Date of Patent: Oct. 27, 1987

[54] AIR REDUCTION CONTROL FOR OIL-TREATING VESSELS

[75] Inventors: Virgil D. Burns; Albert E. Martin, both of Odessa, Tex.

[73] Assignee: Conoco Inc., Ponca City, Okla.

[21] Appl. No.: 716,085

[22] Filed: Mar. 26, 1985

[51] Int. Cl.[4] ..... F23D 14/82

[52] U.S. Cl. ..... 431/346; 137/599; 251/363

[58] Field of Search ..... 431/354, 346; 110/163; 60/39.11; 48/180.1, 192; 220/88; 123/142; 137/599; 251/361, 363; 98/41.3

[56] References Cited

U.S. PATENT DOCUMENTS

| | | | |
|---|---|---|---|
| 1,138,416 | 5/1915 | Roberts | 431/354 |
| 1,260,442 | 3/1918 | Pickup | 431/354 |
| 2,898,978 | 8/1959 | Kitchen et al. | 60/39.11 X |
| 3,079,242 | 2/1963 | Glasgow | 431/346 X |
| 3,711,259 | 1/1973 | Gurney | 431/346 X |
| 3,814,576 | 6/1974 | Brockhurst | 431/354 |
| 3,918,889 | 11/1975 | Green | 431/346 |
| 4,243,176 | 1/1981 | Hays | 431/354 X |
| 4,613,303 | 9/1986 | Willis et al. | 431/346 |

FOREIGN PATENT DOCUMENTS 378369 7/1923 Fed. Rep. of Germany ..... 431/354

OTHER PUBLICATIONS

"Firetube Combustion Air Controllers" sold by the C-E Natco Division of Combustion Engineering, Inc., of Tulsa, Oklahoma, catalog p. No. TSL-1329-A1, dated Aug. 11, 1980.

*Primary Examiner*—Margaret A. Focarino

*Attorney, Agent, or Firm*—Richard K. Thomson

[57] ABSTRACT

A heater treater apparatus includes a vessel, a burner for heating a material contained in the vessel, an air intake passage for directing air to the burner, a flame arrester operatively associated with the air intake passage for preventing flames from the burner from extending past the flame arrester, and an air damper for controlling a flow rate of intake air drawn through the flame arrester. The air damper includes a fixed circular first plate having a first plurality of circumferentially spaced plate openings therethrough, and a similarly constructed rotatable circular second plate. The second plate may be rotated relative to the first plate from an open first position to a second position wherein the plate openings of the first plate are at least partially blocked by the second plate.

18 Claims, 7 Drawing Figures

AIR REDUCTION CONTROL FOR OIL-TREATING VESSELS

BACKGROUND OF THE INVENTION

1. Field Of The Invention

The present invention relates generally to fired oil field vessels for heating a fluid, and particularly to such vessels including a damper system for maximizing the efficiency of a burner of the fired vessels.

2. Description Of The Prior Art

In oil field operations, the produced hydrocarbons coming directly from a well are often immediately directed to a vertical heater treater apparatus which heats the produced well fluid and directs it through a series of baffles and conduits to separate water from the hydrocarbons and to separate gaseous hydrocarbons from liquid hydrocarbons.

Such heater treaters typically have a U-shaped fire tube extending horizontally into an elongated vertical vessel, and have a burner which directs a flame into the lower leg of the fire tube. The well fluid produced from the well flows past the fire tube and is heated thereby so as to aid in breaking the oil-water emulsion so as to separate the water from the hydrocarbons.

The nature of the burner installation on such oil field heater treaters is such that a combustion air intake passage is located behind the burner and typically a flame arrester constructed from a dense metallic mesh perhaps six to eight inches thick is placed across the air intake inlet to prevent flames from the burner from passing therethrough.

Since large amounts of energy are utilized in such heater treaters, it is desirable to maximize the efficiency of the burners.

One technique which has previously been known for use with burners generally, as opposed to specific application thereof to oil field heater treaters, involves the variation of the amount of excess combustion air which is provided to a burner. This can be accomplished by adjusting a damper which controls the area of the air intake inlet.

SUMMARY OF THE INVENTION

The present invention provides an oil field heater treater which includes an air damper means especially designed for use in conjunction with a flame arrester so that the area of the combustion air intake inlet can be precisely controlled so as to maximize the efficiency of the burner by controlling the level of excess combustion air provided to the burner.

This apparatus includes a vessel, a burner for heating a material contained in the vessel, air intake passage means for directing air to the burner, a flame arrester disposed in the air intake passage means for preventing flames from the burner from extending past the flame arrester, and an air damper means for controlling a flow rate of intake air drawn through the flame arrester.

The air damper means includes a fixed circular first plate having a first plurality of circumferentially spaced plate openings disposed therethrough. The air dampener means also includes a rotatable circular second plate coaxially mounted relative to the first plate and having a second plurality of circumferentially spaced plate openings disposed therethrough.

The second plate is rotatable relative to the first plate between an open first position wherein the second plurality of plate openings is in registry with the first plurality of plate openings, and a second position wherein the first plurality of plate openings is at least partially blocked by the second plate.

Preferably the air damper means also includes a gasket means between the first and second plates for sealing between the first and second plates and substantially preventing any air flow through the first plurality of plate openings when the second plate is in a fully closed position wherein the first plurality of plate openings are completely blocked.

An axial compression means is operatively associated with the first and second plates for urging the second plate toward the first plate and for thereby increasing the seal between the first and second plates.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 5 illustrates the air damper means in a fully open position. FIG. 6 illustrates the air damper means in a partially closed position. FIG. 7 illustrates the air damper means in a fully closed position.

DETAILED DESCRIPTION OF THE PREFERRED EMBODIMENTS

Figure 1:
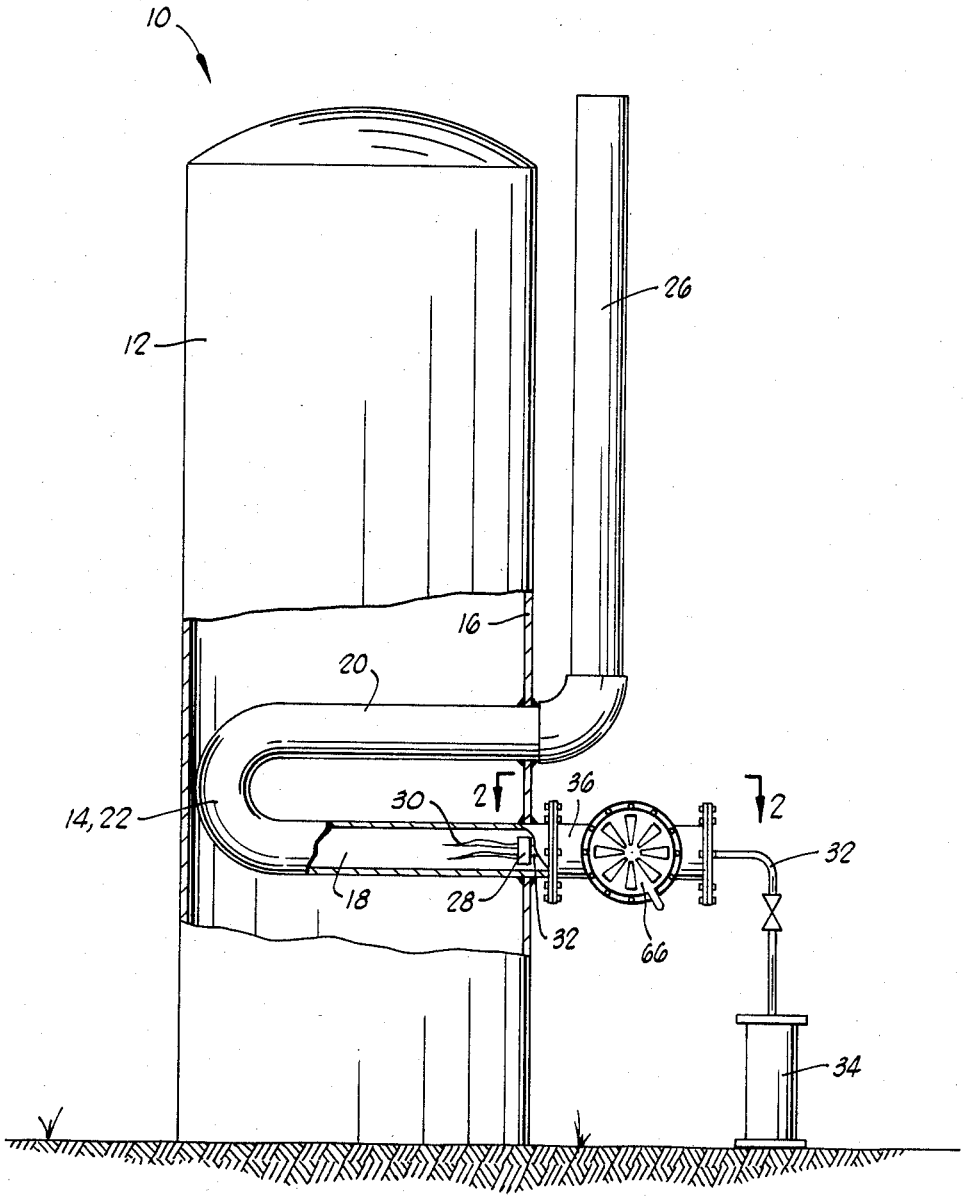
FIG. 1 is an elevation, schematic, partly sectioned view of the oil field heater treater of the present invention.

Referring now to the drawings, and particularly to FIG. 1, the oil field heater treater apparatus of the present invention, which may be generally referred to as a heater apparatus, is shown and generally designated by the numeral 10.

The apparatus 10 includes a vessel 12 which is schematically shown. As will be understood by those skilled in the art, there are a number of piping connections to the vessel 12, which are not shown, through which the produced well fluid is directed to the vessel 12 and through which the various components, such as water, gas and liquid hydrocarbons, are subsequently drawn from the vessel 12 after they are separated.

A U-shaped fire tube 14 extends through a wall 16 of the vessel 12 and horizontally into the vessel 12.

The well fluid which flows through the vessel 12 flows past the U-shaped fire tube 14 and is heated thereby to aid in breaking the oil-water emulsion to separate water from the well fluid. The well fluid is generally heated to a temperature within the range of 130°–140° F. by the fire tube 14 to break the oil-water emulsion.

The fire tube 14 includes a lower horizontal leg 18, and an upper horizontal leg 20, which are connected by a U-shaped end piece 22.

An outer end of upper leg 20 is connected by an elbow 24 to a vertical exhaust stack 26.

Located adjacent an outer end of lower leg 18 is a burner 28 which directs flames such as indicated at 30 into the lower leg 18 of fire tube 14.

The burner 28 typically burns liquid hydrocarbons provided by a fuel supply line 32 from a fuel source 34.

An air intake manifold 36 is constructed of tubular members and its inner bore defines an air intake passage means 38 (see FIG. 3) which supplies combustion air from the atmosphere through a combustion air inlet 40 to the burner 28.

Figure 2:
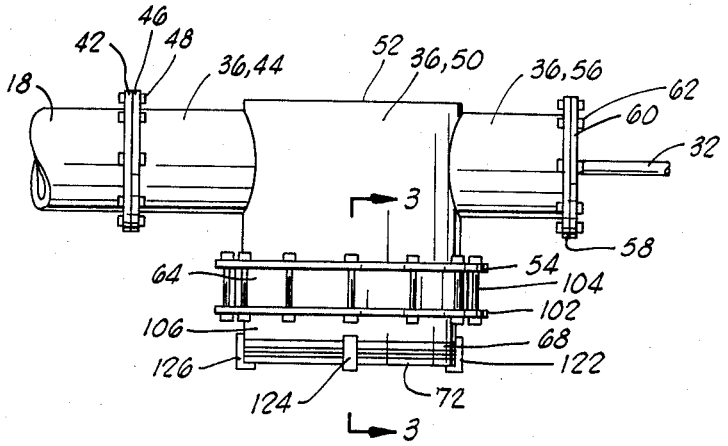
FIG. 2 is a plan view taken along line 2—2 of FIG. 1 illustrating the air intake passage means, the flame arrester and the air damper means.

The air intake manifold 36 is best seen in FIG. 2 which is a plan view thereof.

The outer end of lower leg 18 of fire tube 14 has a flange 42 thereon to which the air intake manifold 36 connects. Air intake manifold 36 includes a first leg 44 which has a flange 46 which is attached to flange 42 by a plurality of bolts such as 48.

First leg 44 intersects and communicates with a second enlarged diameter leg 50.

A first end 52 of second leg 50 is closed, and a second end of second leg 50 is defined by a flange 54.

Air intake manifold 36 also includes a third leg 56 extending from a side of second leg 50 opposite first leg 54. A free end of third leg 56 includes a flange 58.

A blind flange 60 is attached to flange 58 by connecting means such as bolts 62 and the fuel supply line 32 extends through the blind flange 60 in a sealing manner such as may be provided by various couplings and the like.

A flame arrester 64 is disposed across the inlet 40 to air intake passage means 38 for preventing flames from the burner 28 from extending past flame arrester 64 in the event of a backfire or the like of burner 28. Flame arrester 64 is generally circular in shape having a diameter slightly greater than the diameter of air intake passage 38 at its inlet 40 and having a thickness on the order of six to eight inches. The flame arrester 64 is constructed from a dense, wire-mesh type material. The flame arrester 64 is itself a part of the prior art and is a commercially available item and need not be described in detail here.

An air damper means 66 adjacent the flame arrester 54 provides a means for controlling a flow rate of intake air drawn through the flame arrester 64.

The air damper means 66 will now be described with regard to FIGS. 3 and 4.

Air damper 66 includes a fixed circular first plate 68 having a first plurality of circumferentially spaced plate openings 70 disposed therethrough.

Damper means 66 also includes a rotatable circular second plate 72 coaxially mounted relative to first plate 68 about a common central axis 74. Second plate 72 has a second plurality of circumferentially spaced plate openings 76 disposed therethrough.

Figure 5:
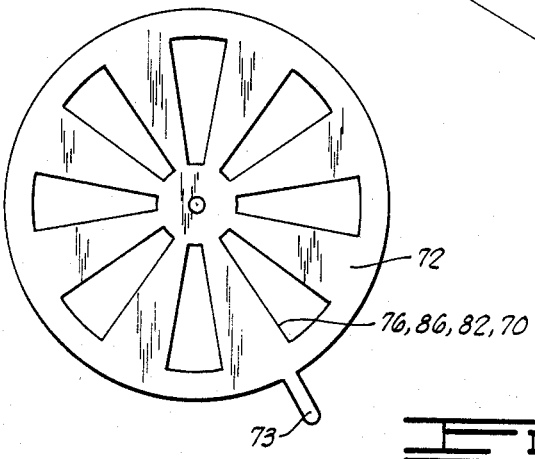
FIGS. 5, 6 and 7 are sequential elevation views showing various relative positions of the first and second plates of the air damper means.
Figure 6:
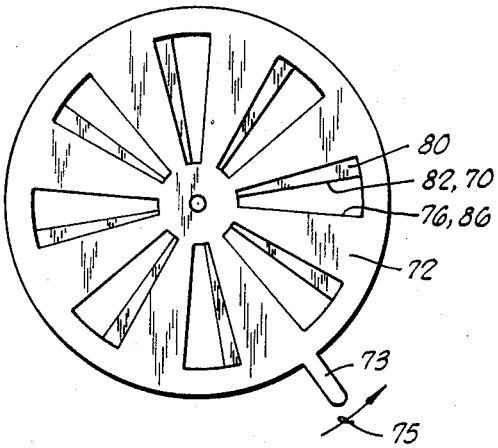
Figure 7:
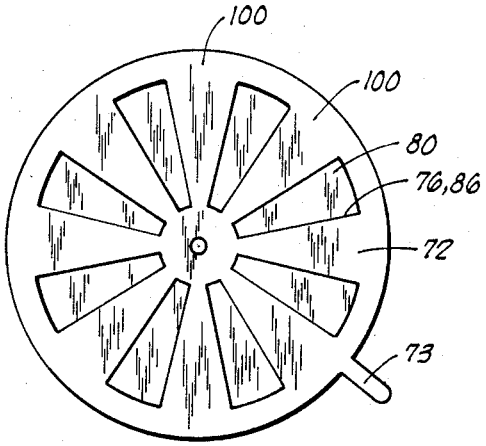

Second plate 72 is rotatable relative to first plate 68 from a fully open position schematically illustrated in FIG. 5, through a plurality of partially closed positions such as illustrated in FIG. 6, to a fully closed position as shown in FIG. 7.

The second plate 72 includes a handle 73 which may be generally referred to as an operator means 73 attached to the second plate 72 for rotating the second plate 72 relative to the first plate 68. In FIGS. 5, 6 and 7, the second plate 72 is rotated counterclockwise as indicated by arrow 75 to move it from the open position of FIG. 5 to the closed position of FIG. 7.

In the fully open position of FIG. 5, the second plurality of plate openings 76 is in registry with the first plurality of plate openings 70. In the partially closed position of FIG. 6, the first plurality of plate openings 70 is partially blocked by the second plate 72. In the fully closed position of FIG. 7, the first plurality of plate openings 70 is completely blocked by second plate 72.

The air damper means 66 also includes gasket means 78 between first and second plates 68 and 72 for sealing between first and second plates 68 and 72 and for substantially preventing any air flow through the first plurality of plate openings 70 when the second plate 72 is in its fully closed position as illustrated in FIG. 7.

The gasket means 78 includes a first planar gasket 80 attached to the first plate 68. Preferably, first planar gasket 80 is bonded to first plate 68 by gluing or the like. The planar gasket 80 may be constructed from conventional sheet asbestos gasket material.

The first planar gasket 80 is substantially coextensive with the first plate 68 and has a first plurality of gasket openings 82 therethrough which are coextensive with the first plurality of plate openings 70.

Gasket means 78 further includes a second planar gasket 84 which is bonded to the second plate 72 and is substantially coextensive therewith. Second planar gasket 84 similarly includes a second plurality of gasket openings 86 disposed therethrough which are coextensive with the second plurality of plate openings 76 of second plate 72.

Figure 3:
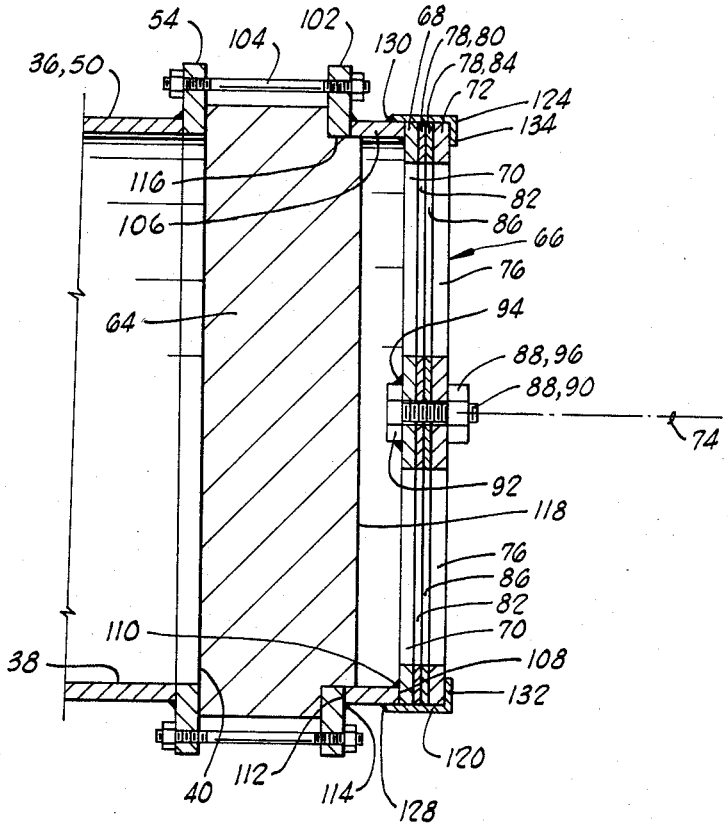
FIG. 3 is an elevation, sectioned, somewhat schematic view of the flame arrester and the air damper means taken along line 3—3 of FIG. 2.

As seen in FIG. 3, the first and second planar gaskets 80 and 84 are in sealing engagement with each other.

The damper means 66 further includes an axial compression means 88 (see FIG. 3) operatively associated with the first and second plates 68 and 72 for urging the second plate 72 toward the first plate 68 and for thereby compressing the second planar gasket 84 against the first planar gasket 80 to increase the sealing effectiveness therebetween. Axial compression means 88 includes a threaded bolt 90 having a head 92 welded to the back side of first plate 78 as indicated at 94.

The bolt 90 extends through central axial openings disposed through first plate 68, first and second planar gaskets 80 and 84, and second plate 72, and lies along the central axis 74 of the first and second plates 68 and 72.

Axial compression means 88 further includes a threaded nut 96 which engages the shaft of threaded bolt 90 and can be made up on bolt 90 to vary the compression loading between the first and second plates 68 and 72.

Threaded bolt 90 also provides a central axle upon which the second plate 72 rotates relative to first plate 68.

The gasket means 78 and the axial compression means 88 also serve yet another purpose. The combination of gasket means 78 and axial compression means 88 also comprise a retaining means operably associated with the first and second plates 68 and 72 for retaining the second plate 72 in a desired position relative to the first plate 68. Either of the gaskets 80 or 84 may generally be described as a layer of friction material between the first and second plates 68 and 72, and the axial compression means 88 urges the second plate 72 toward the first plate 68 so that this layer of friction material creates a frictional force which must be overcome to rotate the second plate 72 relative to the first plate 68.

Also, the gasket means 78 prevents the two plates 68 and 72, which preferably are constructed from steel plate, from rusting together, and thus creating undesirable difficulty in rotating the second plate 72.

Each of the openings of the first plurality of plate openings 70 can generally be described as being substantially pie-shaped openings 70. Each of the pie-shaped openings 70 are substantially identical in size and shape and they are equally circumferentially spaced about the central axis 74 of first plate 68.

Figure 4:
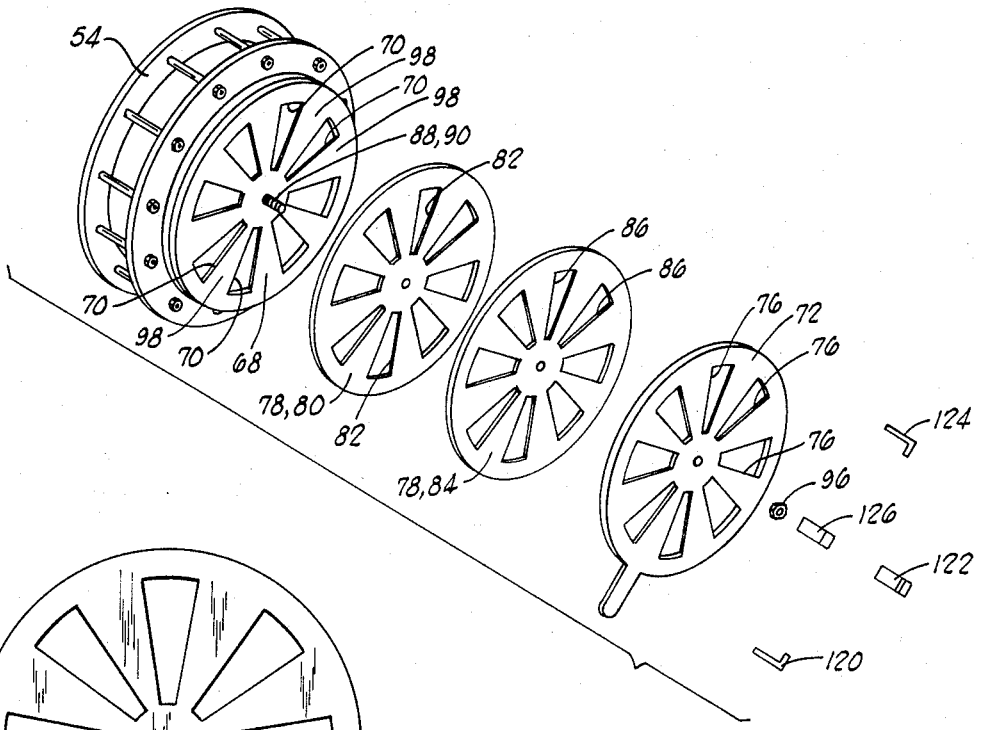
FIG. 4 is an isometric, exploded view of the air damper means as assembled with the flame arrester.

Adjacent ones of the pie-shaped plate openings 70 are separated by substantially pie-shaped solid plate portions 98 (see FIG. 4). The pie-shaped solid plate portions 98 have circumferential widths somewhat greater than the circumferential widths of the pie-shaped plate openings 70 at a given radial distance from the central axis 74 of the first plate 68.

As is apparent from viewing FIGS. 5, 6 and 7, the second plurality of plate openings 76 of second plate 72, and also the first plurality of gasket openings of first planar gasket 80 and the second plurality of gasket openings 86 of second planar gasket 84 are substantially identical in size, shape and relative orientation to the first plurality of pie-shaped plate openings 76, so that when the air dampener means is in its fully open position as illustrated in FIG. 5, all of the first plurality of pie-shaped plate openings 70, first plurality of pie-shaped gasket openings 82, second plurality of pie-shaped gasket openings 86, and second plurality of pie-shaped plate openings 76, are directly overlaid and may be said to be substantially coextensive.

As is apparent in FIG. 7, when the second plate 72 is rotated to its fully closed position relative to first plate 68, the first plurality of pie-shaped plate openings 70 and the first plurality of pie-shaped gasket openings 82 are completely blocked by a plurality of substantially pie-shaped solid portions 100 of second plate 72 separating the plate openings 76 thereof.

The flame arrester 64 is sandwiched between the first flange 54, which as previously described is attached to the end of leg 50 of air intake manifold 36, and a second annular flange 102. A plurality of connecting means such as bolts 104 connect the first and second flanges 54 and 102 about the flame arrester 64.

The air damper means 66 is attached to this second flange 102.

Air damper means 66 includes an annular skirt 106 which is concentric with first plate 68 and has a first end 108 attached to first plate 68 substantially adjacent a radially outer edge of first plate 68 by welding such as indicated at 110.

The skirt 106 extends axially from first plate 68 to second flange 102 and has a second end 112 thereof attached to second flange 102 by welding as indicated at 114.

As schematically illustrated in FIG. 3, the flame arrester 64 extends away from the first flange 54 through a central opening 116 of second flange 102 past the second flange 102 toward the first plate 68. Although the flame arrester 64 is schematically illustrated in FIGS. 2 and 3 as being one piece and having a slightly reduced diameter portion extending forward past second flange 102, actually the flame arrester 64 is constructed in pie-shaped segments and it is some of the structural members defining the edges of those pie-shaped segments which actually extend forward past the second flange 102. As previously mentioned, the flame arrester 64 is itself a commercially available item, and for that reason, the details thereof have not been shown. All that is important to the present invention is to realize the fact that a forwardmost portion 118 of flame arrester 64 does extend slightly past the flange 102. This must be taken into account in the design of the damper means 66.

The annular skirt 106 previously described in effect serves as a spacer ring 106 so that the first plate 68 of damper means 66 clears the forwardmost portion 118 of flame arrester 64 when the air damper means 66 is assembled with the flame arrester 64 as seen in FIG. 3.

Also as seen in FIGS. 3 and 4, the air damper means 66 includes a plurality of L-shaped circumferentially spaced plate holder tabs 120, 122, 124 and 126 which as seen in FIG. 3 are attached to skirt 106 by welding as indicated at 128 and 130. The tabs 120–126 extend axially past second plate 72 and have radially inward extending portions such as 132 and 134 which assist in holding the second plate 72 in place relative to the first plate 68.

MANNER OF OPERATION OF THE INVENTION

The heater apparatus 10 with the adjustable air damper 66 is generally utilized in the following manner.

Typically, the heater apparatus 10 will have the position of its air damper 66 adjusted several times during a season.

The burner 28 is typically operated in an on-off fashion, that is, it is either completely on or completely off and the amount of fuel directed to the burner is typically a constant value. The input of heat to the fluid in the vessel 12 is controlled by turning the burner 28 on and off, and is not generally regulated by varying the amount of fuel directed to the burner.

When the burner 28 is on, the optimum flow rate of combustion air thereto will remain substantially constant so long as the prevailing atmospheric conditions do not change.

Thus, the heater apparatus 10 typically will have the position of its damper means 66 set at an optimum point, and the damper means 66 may not be reset for several months until there has been a substantial change in ambient conditions, such as a change of seasons, a change in direction of prevailing winds, or the like.

The optimum position of the damper means 66 is selected in the following manner.

A flue gas analyzer (not shown) can be utilized to analyze the exhaust gas in the exhaust stack 26 for both oxygen content and for the presence of unburned fuel. It is desired to partially close the damper means 66 so as to minimize the amount of excess oxygen present in the flue gas, while still providing enough excess oxygen to prevent any unburned fuel from passing into the exhaust stack 26.

In a heater treater apparatus similar to that illustrated in the present application, but which did not have a damper and instead had a fully open flame arrester 64, approximately 10% oxygen content was measured in the flue gases in exhaust stack 26.

After modification of the heater treater to include the adjustable damper means 66, and after subsequently partially closing the damper means 66 to lower the intake rate of combustion air, it was determined that the oxygen content in the flue gas in exhaust stack 26 was preferably lowered to about 3%. When oxygen content was lowered below 3%, unburned fuel showed up in the flue gases.

It will be appreciated that it is inefficient to pass unnecessary volumes of air through the fire tube 14 because those volumes of air necessarily must be heated just as are the necessary combustion gases and necessary combustion air in order to achieve a temperature of the fire tube 14 sufficient to accomplish the heating task at hand. The heat transferred to this unnecessary excess combustion air, however, is simply wasted and passes out the exhaust stack 26 without aiding in any manner in the combustion process. Thus, by minimizing the amount of excess combustion air present to no more than that which is absolutely necessary to completely burn the fuel provided to burner 28, a substantial savings in fuel is provided.

The second plate 72 of damper means 66 will remain in place relative to first plate 68 once it is set in the manner just described due to the frictional engagement between the first and second plates 68 and 72 provided by the seal means 78.

Subsequently, if there is a significant change in ambient conditions, the position of damper means 66 can be reset by again analyzing the flue gases in exhaust stack 26 in the manner just described.

Thus it is seen that the apparatus of the present invention readily achieves the ends and advantages mentioned as well as those inherent therein. While certain preferred embodiments of the present invention have been illustrated and described for the purposes of the present application, numerous changes in the arrangement and construction of parts may be made by those skilled in the art which changes are encompassed within the scope and spirit of the present invention as defined by the appended claims.

What is claimed is:

1. A heater apparatus, comprising:

a vessel;

a burner for heating a material contained in said vessel;

air intake passage means for directing air to said burner;

a flame arrester operatively associated with said air intake passage means for preventing flames from said burner from extending past said flame arrester; and an air damper means for controlling a flow rate of intake air drawn through said flame arrester, said air damper means including:

a. a fixed circular first plate having a first plurality of circumferentially spaced plate openings disposed therethrough;

b. a rotatable circular second plate coaxially mounted relative to said first plate, and having a second plurality of circumferentially spaced plate openings disposed therethrough, said second plate being rotatable relative to said first plate between an open first position wherein said second plurality of plate openings is in registry with said first plurality of plate openings, and a second fully closed position wherein said first plurality of plate openings is substantially completely blocked by said second plate; and c. gasket means between said first and second plates for (i) sealing between said first and second plates substantially preventing any air flow through said first plurality of plate openings when said second plate is in its said fully closed position, and (ii) creating a frictional force which must be overcome to rotate said second plate relative to said first plate.

2. The apparatus of claim 1, wherein:

said gasket means includes a first planar gasket attached to one of said first and second plates and substantially coextensive therewith, said first planar gasket having a first plurality of gasket openings therethrough which are coextensive with the plurality of plate openings of said one of said first and second plates.

3. The apparatus of claim 2, wherein:

said gasket means further includs a second planar gasket attached to the other one of said first and second plates and substantially coextensive therewith, said second planar gasket having a second plurality of gasket openings therethrough which are coextensive with the plurality of plate openings of said other of said first and second plates, said first and second planar gaskets being in sealing engagement with each other.

4. The apparatus of claim 3, wherein said air damper means further includes:

axial compression means, operatively associated with said first and second plates, for urging said second plate toward said first plate and for thereby compressing said second planar gasket against said first planar gasket.

5. The apparatus of claim 1, wherein said air damper means further includes:

axial compression means, operatively associated with said first and second plates, for urging said second plate toward said first plate and for thereby increasing a sealing effectiveness of said gasket means therebetween.

6. The apparatus of claim 5, wherein:

said axial compression means includes a threaded nut and bolt means connecting said first and second plates along central axes thereof.

7. The apparatus of claim 1, wherein:

said first plurality of circumferentially spaced plate openings of said first plate is further characterized as a first plurality of substantially equal size pie-shaped plate openings, adjacent ones of said pie-shaped plate openings being separated by substantially pie-shaped solid plate portions, said pie-shaped solid plate portions having circumferential widths greater than circumferential widths of said pie-shaped plate openings at a given radial distance from a center of said first plate.

8. The apparatus of claim 7, wherein:

said second plurality of circumferentially spaced plate openings of said second plate is further characterized as a second plurality of substantially equal size pie-shaped plate openings, each of which is substantially equal in size and shape to said openings of said first plurality of pie-shaped plate openings, adjacent ones of said second plurality of pie-shaped plate openings being separated by substantially pie-shaped solid plate portions of said second plate; and wherein each of said openings of said first plurality of pie-shaped plate openings of said first plate is completely blocked by one of said pie-shaped solid plate portions of said second plate when said second plate is in a fully closed position relative to said first plate.

9. The apparatus of claim 1, wherein:

said openings of said first plurality of plate openings of said first plate are substantially equal in size and shape and are substantially equally circumferentially spaced;

adjacent ones of said openings of said second plurality of plate openings of said second plate are separated by solid plate portions; and said second plate is rotatable to a fully closed position relative to said first plate wherein each of said openings of said first plurality of plate openings of said first plate is completely blocked by one of said solid plate portions of said second plate.

10. The apparatus of claim 9, wherein:

said openings of said second plurality of plate openings of said second plate are of substantially the same size and shape as said openings of said first plurality of plate openings; and said openings of said second plurality of openings are substantially coextensive with said openings of said first plurality of openings when said second plate is in its said open first position relative to said first plate.

11. The apparatus of claim 1, wherein:

said flame arrester is substantially circular in shape and is sandwiched between first and second annular flanges with a connecting means connecting said first and second flanges about said flame arrester;

said first flange is attached to an inlet of said air intake passage means; and said air damper means is attached to said second flange.

12. The apparatus of claim 11, wherein:

said air damper means includes an annular skirt concentric with and having a first end of said skirt attached to said first plate substantially adjacent a radially outer edge of said first plate, said skirt extending axially from said first plate to said second flange and having a second end thereof attached to said second flange.

13. The apparatus of claim 12, wherein:

said flame arrester extends away from said first flange through a central opening of said second flange past said second flange toward said first plate; and said annular skirt serves as a spacer ring so that said first plate clears said flame arrester when said air damper means is assembled with said flame arrester.

14. The apparatus of claim 12, wherein:

said annular skirt is welded at its said first and second ends to said first plate and to said second flange, respectively.

15. The apparatus of claim 12, wherein:

said air damper means further includes a plurality of circumferentially spaced plate holder tabs attached to said skirt and extending axially past said second plate and radially inward to hold said second plate in place relative to said first plate.

16. The apparatus of claim 1, wherein:

said air damper means further includes operator means, attached to said second plate, for rotating said second plate relative to said first plate.

17. The apparatus of claim 1, wherein:

said air damper means further includes retaining means, operably associated with said first and second plates, for retaining said second plate in a desired position relative to said first plate.

18. The apparatus of claim 17, wherein said retaining means further includes:

an axial compression means, operably associated with said first and second plates for urging said second plate toward said first plate, said gasket means comprising a layer of friction material positioned between said first and second plates, such that when said axial compression means urges said second plate toward said first plate, said layer of friction material creates said frictional force.

* * * * *